US006525938B1

(12) United States Patent
Chen

(10) Patent No.: US 6,525,938 B1
(45) Date of Patent: Feb. 25, 2003

(54) CIRCUIT BOARD FIXING STRUCTURE OF HEATSINK FAN

(75) Inventor: Chien-Jung Chen, Kaohsiung (TW)

(73) Assignee: Yen Sun Technology Corp. (TW)

( * ) Notice: Subject to any disclaimer, the term of this patent is extended or adjusted under 35 U.S.C. 154(b) by 0 days.

(21) Appl. No.: 10/032,540

(22) Filed: Jan. 2, 2002

(51) Int. Cl.[7] ..... H05K 7/20

(52) U.S. Cl. ..... 361/695; 361/707; 361/709; 361/710; 310/91; 310/63; 310/64; 310/65

(58) Field of Search ..... 361/695, 697, 361/719, 741, 756; 257/721, 722; 174/16.1, 16.3; 165/80.3, 104.33, 122; 310/62, 63, 64; 417/356, 354, 423.14

(56) References Cited

U.S. PATENT DOCUMENTS 3,829,741 A * 8/1974 Athey ..... 174/138 D
4,992,029 A * 2/1991 Harmsen et al. ..... 417/354
6,194,798 B1 * 2/2001 Lopatinsky ..... 310/63
6,249,071 B1 * 6/2001 Lopatinsky et al. ..... 254/254
6,265,797 B1 * 7/2001 Horng ..... 310/90
6,291,912 B1 * 9/2001 Nadir et al. ..... 310/64
6,400,053 B1 * 6/2002 Horng ..... 310/67 R

FOREIGN PATENT DOCUMENTS

TW 382412 * 2/2002 ..... F04D/29/00

* cited by examiner

*Primary Examiner*—Boris L. Chervinsky
(74) *Attorney, Agent, or Firm*—Larson & Taylor, PLC

(57) ABSTRACT

A circuit board fixing structure of a heatsink fan includes a housing having a pivot portion having a periphery provided with multiple poles. The housing is provided with a pair of positioning seats and a conducting wire receiving socket. The two positioning seats are formed with two insertion grooves. A circuit board is mounted in the insertion grooves of the positioning seats of the housing, and has a sensor and a conducting wire. The conducting wire may pass through the conducting wire receiving socket of the housing.

5 Claims, 5 Drawing Sheets

CIRCUIT BOARD FIXING STRUCTURE OF HEATSINK FAN

BACKGROUND OF THE INVENTION

1. Field of the Invention

The present invention relates to a circuit board fixing structure of a heatsink fan, and more particularly to a circuit board of an outer pole type heatsink fan, wherein the fixing structure may be assembled and fixed easily.

2. Description of the Related Art

A conventional heatsink fan structure in accordance with the prior art shown in FIG. 6 is disclosed in the applicant's Taiwanese Patent Publication No. 382412, comprising a base board 90 having a shaft 91 for supporting an impeller 92 to rotate. The outer periphery of the blades 93 of the impeller 92 is combined with a magnet ring 94. The base board 90 is provided with multiple poles 95 for fixing winding coils 97, and an outer frame 96 is mounted on the base board 90. The magnet ring 94 may induce with the coils 97 of the base board 90, so that the impeller 92 may be rotated, and the blades 93 may drive the air to flow. The base board 90 is provided with a controller, and a sensor 98 that may detect the variation of polarity of the magnet ring 94.

In the conventional heatsink fan structure, the controller and the sensor 98 are fixed on the base board 90, so that the mounting work is more inconvenient. In addition, the sensor 98 is remote from the magnet ring 94, so that the sensor 98 cannot detect the variation of polarity of the magnet ring 94 exactly.

SUMMARY OF THE INVENTION

The primary objective of the present invention is to provide a circuit board fixing structure of a heatsink fan, wherein the circuit board may be fixed rapidly and conveniently.

A secondary objective of the present invention is to provide a circuit board fixing structure of a heatsink fan, wherein the sensor of the circuit board may be located at the optimum detection position of the permanent magnet of the rotor, for detecting the variation of polarity of the permanent magnet of the rotor exactly.

A further objective of the present invention is to provide a circuit board fixing structure of a heatsink fan, wherein the conducting wire of the circuit board may be fixed efficiently, thereby preventing the conducting wire from being detached from the connection point when the conducting wire is pulled.

In accordance with the present invention, there is provided a circuit board fixing structure of a heatsink fan which includes a housing having a pivot portion having a periphery provided with multiple poles. The housing is provided with a pair of positioning seats and a conducting wire receiving socket. The two positioning seats are formed with two insertion grooves. A circuit board is mounted in the insertion grooves of the positioning seats of the housing, and has a sensor and a conducting wire. The conducting wire may pass through the conducting wire receiving socket of the housing.

DETAILED DESCRIPTION OF THE PREFERED EMBODIMENTS

Figure 1:
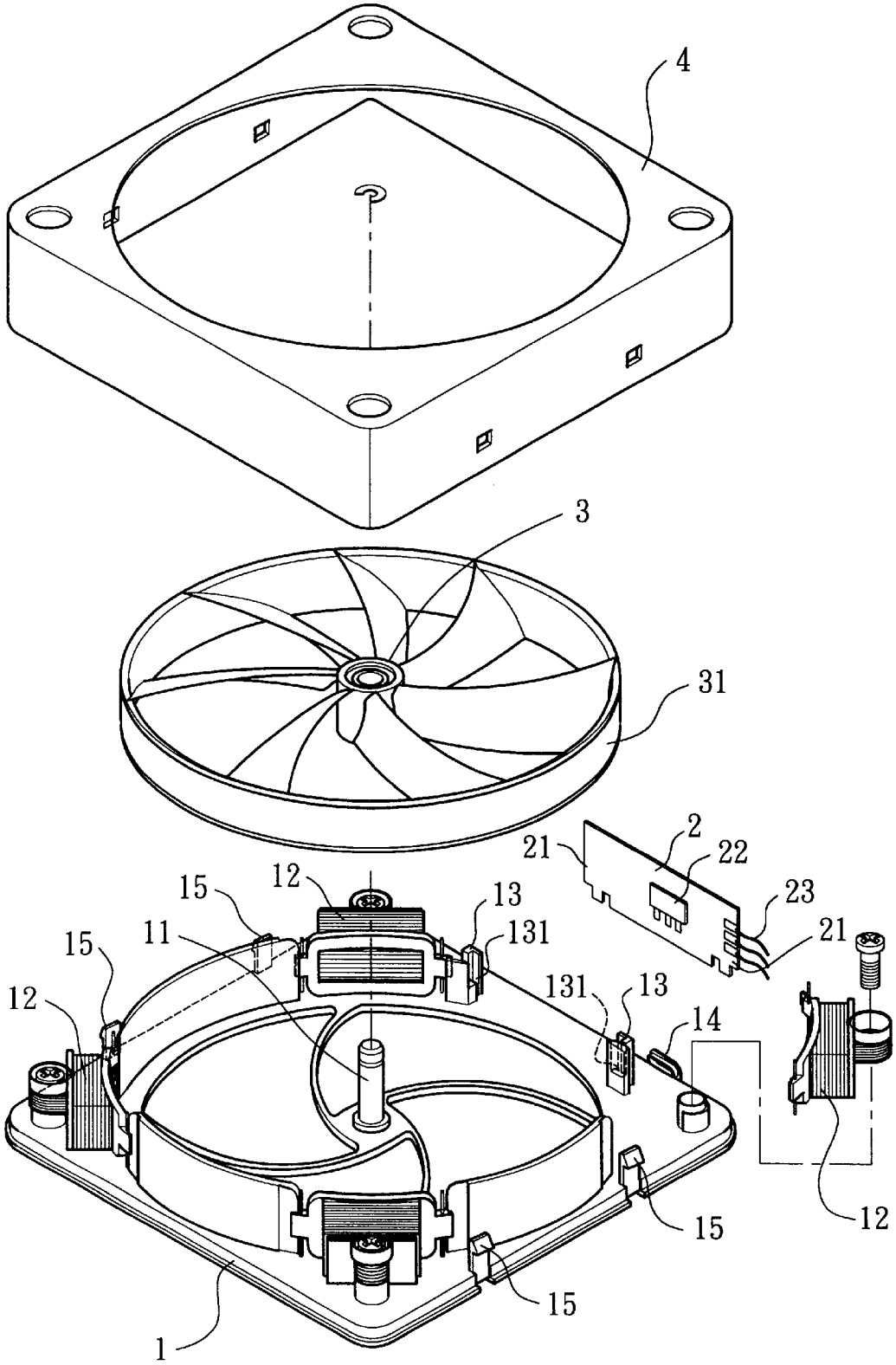
FIG. 1 is an exploded perspective view of a circuit board fixing structure of a heatsink fan in accordance with a first embodiment of the present invention.

Referring to the drawings and initially to FIG. 1, a circuit board fixing structure of a heatsink fan in accordance with a first embodiment of the present invention comprises a housing 1, and a circuit board 2.

The housing 1 may be the housing of a conventional motor, heatsink fan or the like. The housing 1 has a pivot portion 11 that may be a central shaft or a bearing seat, for pivoting a rotor 3 to rotate. The pivot portion 11 has a periphery provided with multiple poles 12 each wound with a conducting wire having predetermined turns. After the poles 12 are energized, the poles 12 may produce different alternating magnetic fields which may form a magnetic force to produce a repulsive action with the permanent magnet 31 of the rotor 3, thereby driving the rotor 3 to rotate.

The housing 1 is provided with a pair of positioning seats 13 each formed with an insertion groove 131 for insertion and fixing of the circuit board 2. In the preferred embodiment of the present invention, the insertion grooves 131 are opposite to each other. The housing 1 is provided with a conducting wire receiving socket 14, and multiple combination posts 15. A cover 4 may be combined with the combination posts 15 of the housing 1 conveniently.

The circuit board 2 may be combined in the insertion grooves 131 of the positioning seats 13 of the housing 1. As shown in the figure, the circuit board 2 has two ends 21 inserted into the insertion grooves 131 of the positioning seats 13 of the housing 1. The circuit board 2 may conventionally include a controller and a sensor 22. The sensor 22 may be designed to be located at a predetermined position. In the preferred embodiment of the present invention, when the sensor 22 is secured on the housing 1, the sensor 22 is located in an angle θ (see FIG. 2) of 3° to 17° of a central axis X of an included angle of two adjacent poles 12 and the pivot portion 11. The angle θ may have a positive value or negative value.

The conducting wire 23 of the circuit board 2 may be used to transfer the signal, and may pass through the conducting wire receiving socket 14 of the housing 1, thereby preventing the conducting wire 23 from being detached from the connection point when the conducting wire 23 is pulled.

Figure 2:
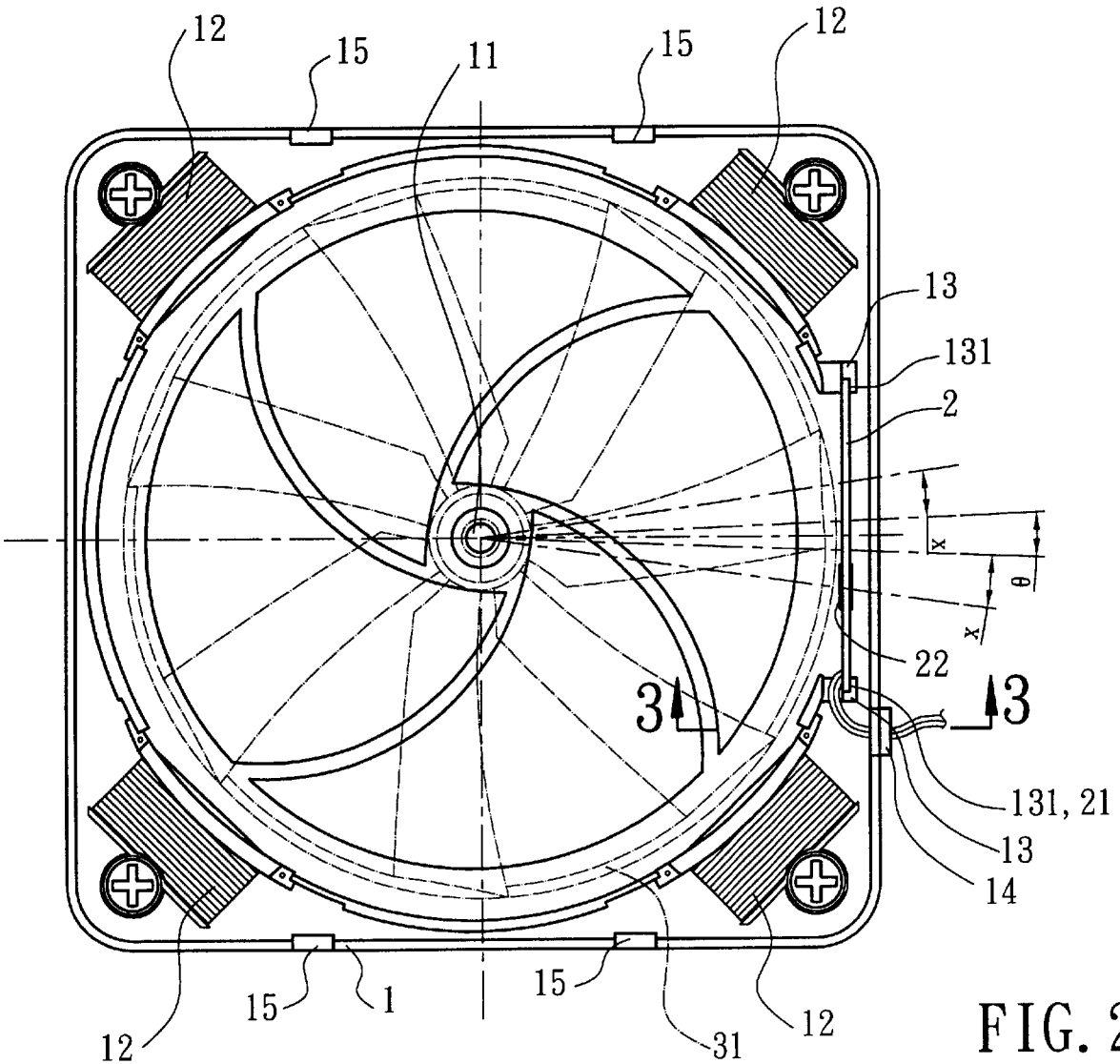
FIG. 2 is a top plan assembly view of the circuit board fixing structure of a heatsink fan as shown in FIG. 1.
Figure 3:
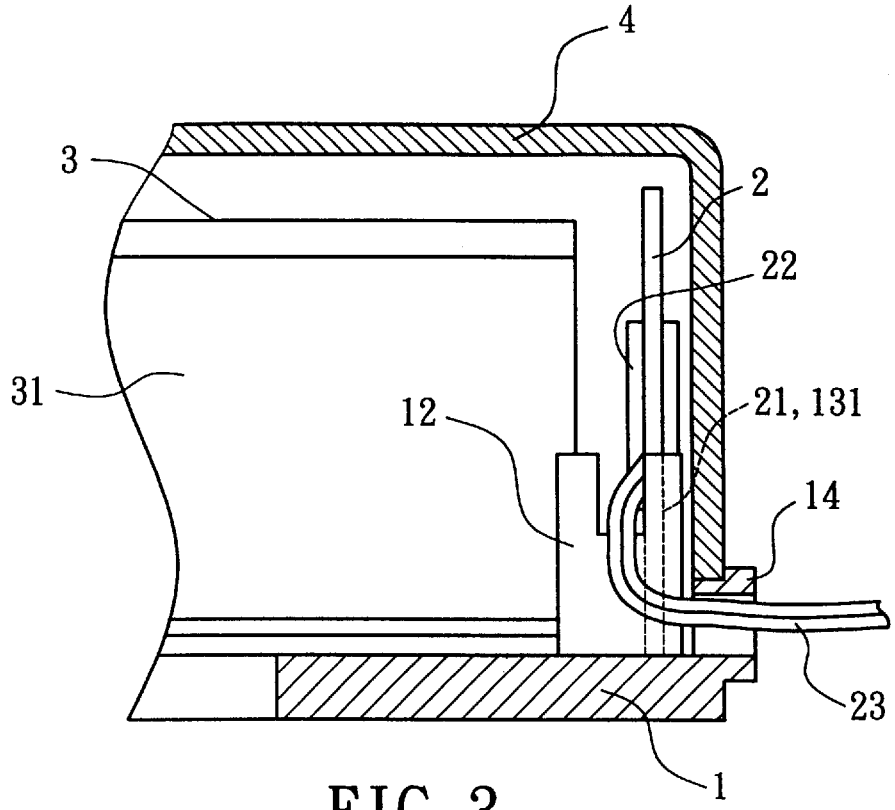
FIG. 3 is a cross-sectional view of the circuit board fixing structure of a heatsink fan taken along line 3—3 as shown in FIG. 2.

Referring to FIGS. 2 and 3, the circuit board fixing structure of a heatsink fan in accordance with the first embodiment of the present invention is assembled.

The two ends 21 of the circuit board 2 may be inserted into the insertion grooves 131 of the positioning seats 13 of the housing 1. The sensor 22 of the circuit board 2 may be designed to be located at a predetermined position. Thus, the sensor 22 may be located at the closest position and thus opposing the permanent magnet 31 which is the radially outer circumference of the rotor 3, for detecting the variation of polarity of the permanent magnet 31 of the rotor 3. The conducting wire 23 of the circuit board 2 may pass the positioning seat 13 of the housing 1, and may pass through the conducting wire receiving socket 14 of the housing 1. Thus, when the conducting wire 23 is pulled, the conducting wire 23 has a double bending by the conducting wire receiving socket 14 of the housing 1 and the positioning seat 13 of the housing 1, so that the conducting wire 23 is not easily detached from the connection point.

Figure 5:
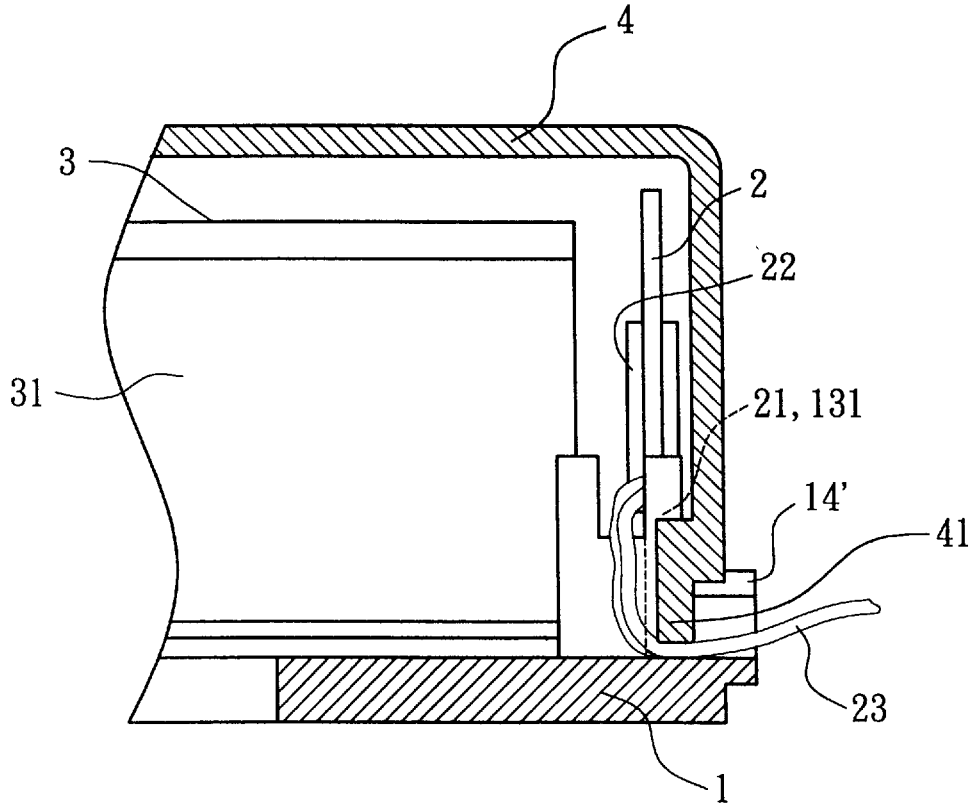
FIG. 5 is a cross-sectional view of the circuit board fixing structure of a heatsink fan as shown in FIG. 4.
Figure 4:
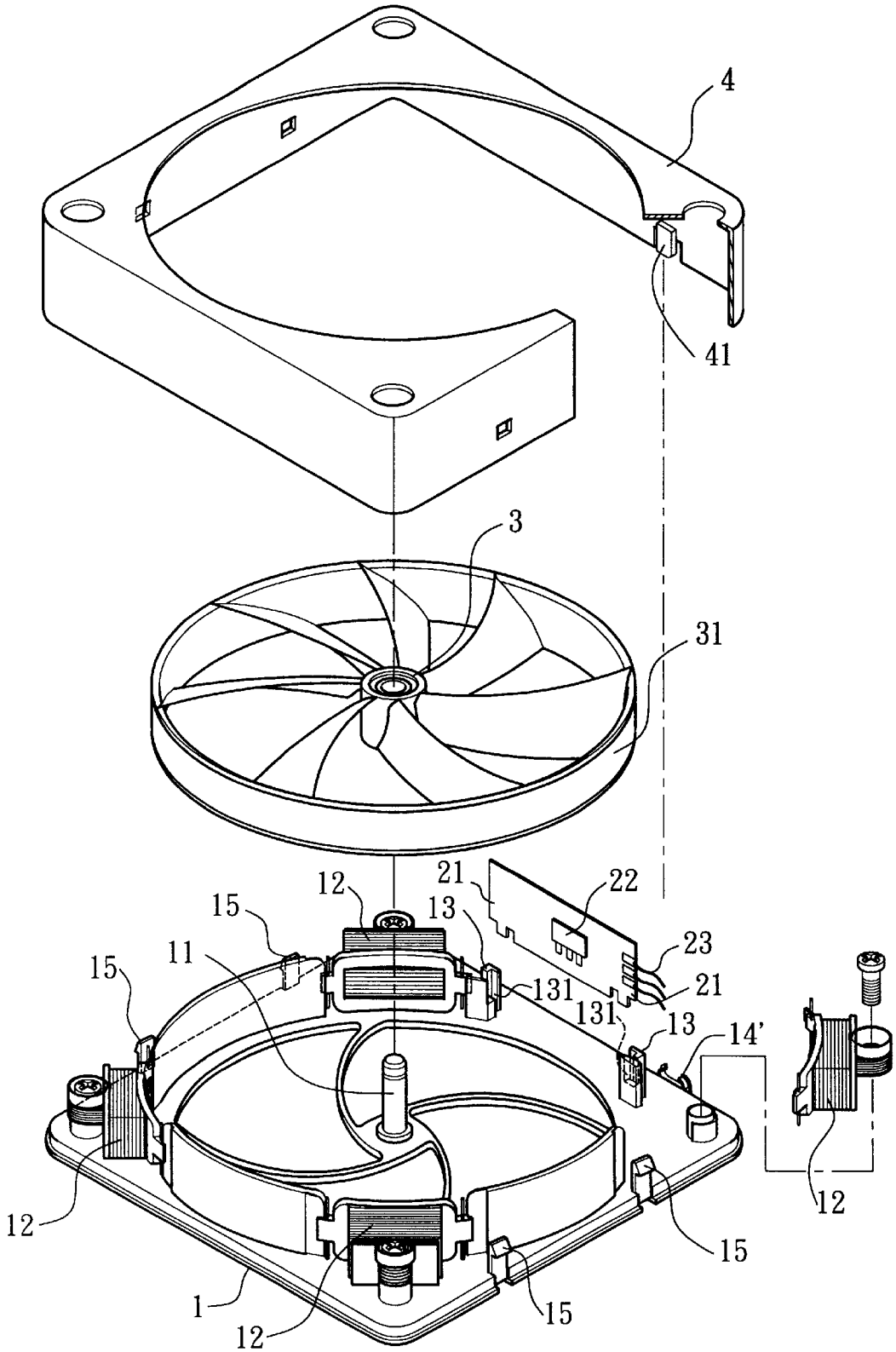
FIG. 4 is an exploded perspective view of a circuit board fixing structure of a heatsink fan in accordance with a second embodiment of the present invention.
Figure 6:
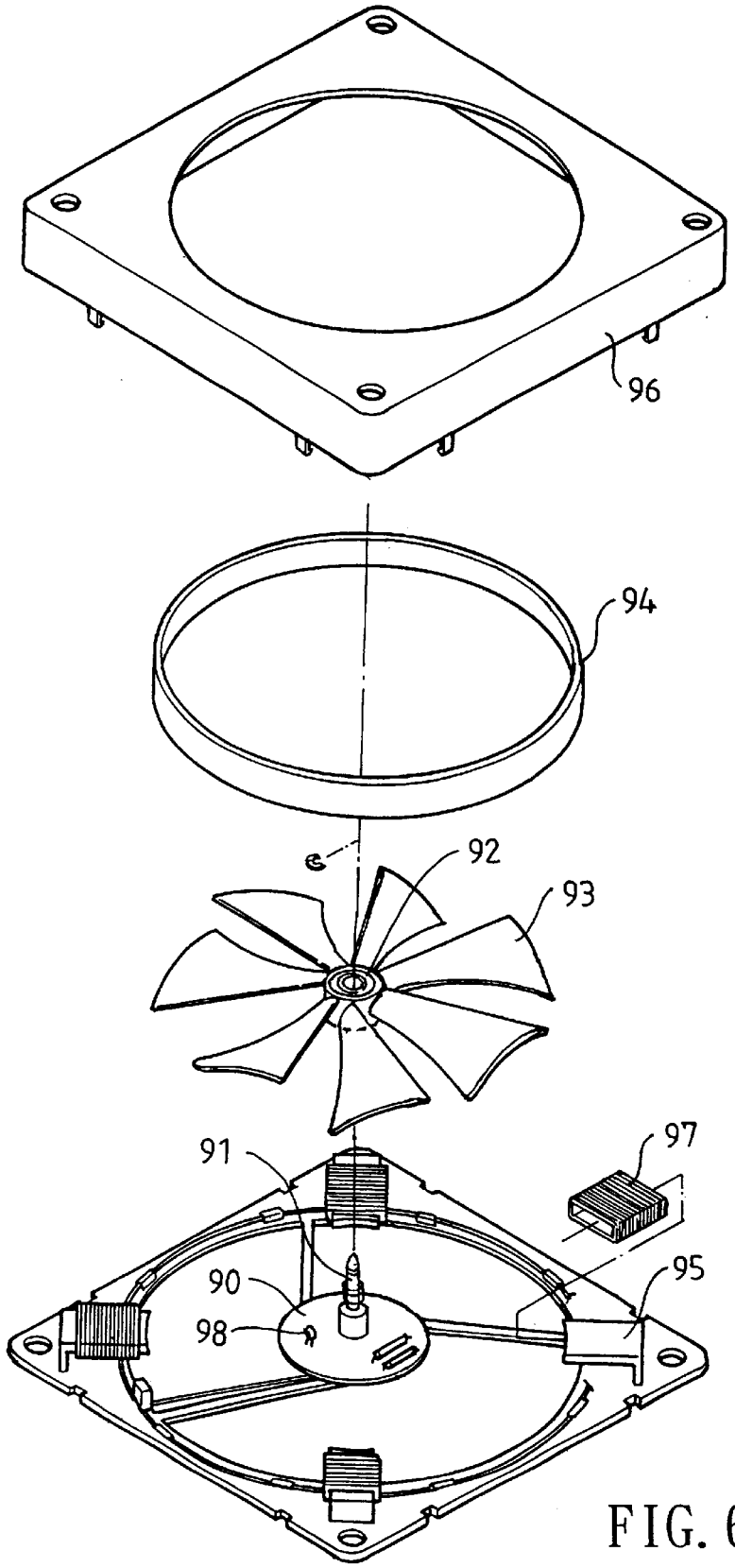
FIG. 6 is an exploded perspective cross-sectional assembly view of a conventional heatsink fan structure in accordance with the prior art.

Referring to FIG. 4, a circuit board fixing structure of a heatsink fan in accordance with a second embodiment of the present invention is shown. The conducting wire receiving socket 14' of the housing 1 may be formed with an opening, and the cover 4 is provided with a press block 41 corresponding to the position of the conducting wire receiving socket 14' of the housing 1. When the cover 4 is combined with the housing 1, the press block 41 may close the opening of the conducting wire receiving socket 14' of the housing 1 as shown in FIG. 5. Thus, the conducting wire 23 of the circuit board 2 may pass through the conducting wire receiving socket 14' of the housing 1 conveniently. In addition, when the conducting wire 23 is pulled, the conducting wire 23 has a double bending by the conducting wire receiving socket 14' of the housing 1, the press block 41, and the positioning seat 13 of the housing 1, so that the conducting wire 23 is not easily detached from the connection point.

Accordingly, in the circuit board fixing structure of a heatsink fan of the present invention, the circuit board may be mounted and fixed in place conveniently and rapidly. In addition, the sensor may be located close to the permanent magnet of the rotor, thereby achieving the optimum detection effect. Further, when the conducting wire is pulled, the conducting wire has a double bending by the conducting wire receiving socket of the housing and the positioning seat of the housing, so that the conducting wire is not easily detached from the connection point.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A circuit board fixing structure of a heatsink fan, comprising:

a housing, having a pivot portion having a periphery provided with multiple poles, the housing provided with at least one positioning seat located between the two adjacent poles, the positioning seat formed with an insertion groove; and a circuit board, mounted in the insertion groove of the positioning seat of the housing, the circuit board having a sensor located between the two poles and opposing a radially outer circumference of a rotor and a conducting wire.

2. The circuit board fixing structure of a heatsink fan as claimed in claim 1, including a pair of said positioning seats, and wherein the insertion grooves of the positioning seats are opposite to each other, and the circuit board has two ends inserted into the insertion grooves of the positioning seats.

3. The circuit board fixing structure of a heatsink fan as claimed in claim 1, wherein the sensor is located in an angle $\theta$ of 3° to 17° of a central axis of an included angle of two adjacent poles and the pivot portion.

4. The circuit board fixing structure of a heatsink fan as claimed in claim 1, wherein the conducting wire of the circuit board passes the positioning seat of the housing, and passes through the conducting wire receiving socket of the housing.

5. A circuit board fixing structure of a heatsink fan, comprising:

a housing, having a pivot portion having a periphery provided with multiple poles, the housing provided with a pair of positioning seats located between two adjacent poles and an opened conducting wire receiving socket, the two positioning seats formed with two opposite insertion grooves;

a circuit board, having two ends mounted in the insertion grooves of the positioning seats of the housing, the circuit board having a sensor and a conducting wire; and a cover, combined with the housing, the cover having a press block that closes an opening of the opened conducting wire receiving socket of the housing.

* * * * *